United States Patent [19]

Pitler et al.

[11] Patent Number: 4,911,886

[45] Date of Patent: Mar. 27, 1990

[54] AUSTENTITIC STAINLESS STEEL

[75] Inventors: Richard K. Pitler, Gibsonia; John F. Grubb, Lower Burrell, both of Pa.

[73] Assignee: Allegheny Ludlum Corporation, Pittsburgh, Pa.

[21] Appl. No.: 169,520

[22] Filed: Mar. 17, 1988

[51] Int. Cl.[4] ..... C22C 30/00

[52] U.S. Cl. ..... 420/586

[58] Field of Search ..... 420/584, 586.1

[56] References Cited

U.S. PATENT DOCUMENTS

| | | | |
|---|---|---|---|
| 3,573,899 | 4/1971 | Groethe | 420/584 |
| 3,716,354 | 2/1973 | Reen | 420/584 |
| 3,836,358 | 9/1974 | Jones | 420/584 |
| 3,837,846 | 9/1974 | Bekcer et al. | 420/584 |
| 3,854,937 | 12/1974 | Muta et al. | 75/128 N |
| 3,865,581 | 2/1975 | Sekino et al. | 420/584 |
| 3,900,316 | 8/1975 | Jones | 420/584 |
| 4,007,038 | 2/1977 | Deverell | 420/40 |
| 4,043,838 | 8/1977 | Deverell | 148/2 |
| 4,086,085 | 4/1978 | McGurty | 420/584 |
| 4,172,716 | 10/1979 | Abo et al. | 420/584 |
| 4,421,557 | 12/1983 | Rossomme et al. | 420/584 |
| 4,487,744 | 12/1984 | De Bold et al. | 420/584 |
| 4,530,720 | 7/1985 | Moroishi et al. | 420/584 |
| 4,545,826 | 10/1985 | McCunn et al. | 148/12 E |

FOREIGN PATENT DOCUMENTS

| | | | |
|---|---|---|---|
| 0207149 | 12/1982 | Japan | 420/584 |
| 0207150 | 12/1982 | Japan | 420/584 |
| 0025942 | 2/1984 | Japan | 420/584 |
| 0211554 | 11/1984 | Japan | 420/584 |
| 0226151 | 12/1984 | Japan | 420/584 |
| 0017048 | 1/1985 | Japan | 420/584 |
| 0077917 | 5/1985 | Japan | 420/584 |
| 2151260A | 7/1985 | United Kingdom | |

*Primary Examiner*—John P. Sheehan
*Assistant Examiner*—David W. Schumaker
*Attorney, Agent, or Firm*—Patrick J. Viccaro

[57] ABSTRACT

An austenitic alloy is provided having a desirable combination of properties by melting an alloy containing 25 to 27 weight percent chromium, 20 to 40 weight percent nickel, 5 to 7.0 percent molybdenum, 0.25 to 0.30 weight percent nitrogen, and the balance iron and incidental impurities. The alloys exhibit a CCCT value of greater than 49 degrees Centigrade, together with other desirable properties, can be so produced, while maintaining the level of resistance to stress corrosion cracking at a level higher than that of AISI Type 316L stainless steel.

17 Claims, No Drawings

AUSTENTITIC STAINLESS STEEL

BACKGROUND OF THE INVENTION

Field of the Invention

This invention relates to austenitic alloys, and in particular, relates to austenitic alloys of the kind which find the application in the chemical process industries, the petrochemical industry, the pulp and paper industry, the power-plant scrubber market, and any other markets requiring a material with high degree of corrosion resistance to chloride pitting, as well as general corrosion resistance.

Those skilled in the art are familiar with various steels and alloys that have hitherto been known for the purposes indicated above. These include the austenitic alloys of (1) the Deverell U.S. Pat. Nos. 4,007,038 and 4,043,838; (2) the alloy of the McCunn et al. U.S. Pat. No. 4,545,826; and (3) the alloy "Avesta 254 SMO". These known materials have in common that they typically contain about 20% of chromium, a large proportion of nickel (24% in the case of the alloys (1) and (2) and 18.0% in the case of alloy (3)), about 6.5% of molybdenum, and the balance iron. The alloy (2) also contains, according to the McCunn et al. patent, 0.15 to 0.30% of nitrogen, though the usual commercial material of alloy (2) is made with a nitrogen aim content on the order of 0.18 to 0.25%. The alloy (3) typically contains 0.2% of nitrogen and 0.7% of copper. The balance is substantially iron, except for incidental impurities in each alloy.

Alloys of the above-indicated compositions are known to exhibit a desirable combination of hot-workability, strength, and resistance to corrosion in various media.

It is known that the alloy material having a chemical composition generally similar to the three above-mentioned alloys usually have substantially austenitic microstructure at room temperature, but there is a tendency, with these highly alloyed materials, to have some development of other microstructural phases, such as the sigma phase and the chi phase. In general the development of these other phases, the sigma phase and the chi phase, is to be avoided, because of the unfavorable effects on the hot workability, the strength, or certain of the other properties of the alloys involved. While the use of alloy materials less highly alloyed would be desirable from the standpoint of avoiding the development of sigma or chi phases, such materials are often accompanied by a decrease in strength and/or corrosion resistance.

In the testing and development of alloys of this kind, it is common, in addition to determining the usual mechanical properties (ultimate tensile strength, yield strength, and elongation), to conduct tests in accordance with ASTM Standard G-48 to determine the CCCT (i.e., the Critical Crevice Corrosion Temperature). The above-mentioned McCunn et al. Patent No. 4,545,826 discloses how the CCCT is favorably influenced by the use of a greater nitrogen content in the alloy. One example at 0.25 weight percent nitrogen achieved, when heat treated and water quenched in a specified manner, a CCCT of about 108 degrees Fahrenheit (42 degrees C.).

In another kind of known corrosion test which is applied to alloys of this sort, the resistance of the materials to stress-corrosion cracking is determined by subjecting samples of the material to exposure in a boiling salt solution. In one of the severest tests of this kind, there is used a boiling aqueous solution containing 42 weight percent of magnesium chloride, a medium in which samples of the alloy (1) survive about 96 hours and samples of the alloy (2) survive 500 hours or more. Other austenitic materials, such as AISI Type 316L stainless steel, in such a test, fail in a time of the order of 20 hours.

It is known for high Cr and Ni bearing materials to maintain the sulfur content of the alloy at a low level, up to 0.006 weight percent, as a measure intended to preserve or promote the hot workability of the maaterial. Alternatively, it may be desirable or necessary to treat the steel with calcium and/or cerium for this purpose as disclosed in the Deverell patents 4,007,038 and 4,043,838.

It is known, in accordance with the prior art, that the presence of molybdenum in greater amounts promotes the obtaining of a higher CCCT, but at the same time, it has a detrimental effect on the phase stability and hot workability of the alloy.

What is needed is a Ni-Cr-Mo containing austenitic stainless steel which remains adequately hot-workable and avoids the development of unwanted sigma-phase microstructure, affording desirably high CCCT values on the order of 49 degrees Centigrade (120 degrees F.) or higher, adequate strength and ductility, and a desirable level of resistance to stress corrosion cracking without the high cost of currently known nickel-base alloy products.

SUMMARY OF THE INVENTION

In accordance with the present invention, austenitic alloys having an above-indicated desirable combination of properties can be obtained by melting an alloy containing 25 to 27 weight percent chromium, 20 to 40 weight percent nickel, 5 to 7.0 percent molybdenum, 0.25 to 0.30 weight percent nitrogen, and the balance iron except for incidental impurities. In particular, it has been discovered that alloys exhibiting a CCCT value of greater than 49 degrees Centigrade, together with other desirable properties, can be so produced, while maintaining the level of resistance to stress corrosion cracking at a level higher than that of AISI Type 316L stainless steel.

DESCRIPTION OF THE PREFERRED EMBODIMENTS

The novel alloys according to the present invention are austenitic alloys which consist essentially of chromium, nickel, molybdenum, nitrogen and iron. They are higher in chromium and richer in nitrogen than the known commercially available materials of this type. Such an alloy with properties or characteristics otherwise satisfactory (hot workability, mechanical properties, resistance to stress-corrosion cracking), provides especially favorable CCCT values, on the order of 49 degrees Centigrade and up. This is accomplished without undue costs for alloy ingredients or expensive heat-treatment steps. Moreover, contrary to what one skilled in the art might expect, such highly alloyed material does not exhibit difficulties arising from the development of sigma-phase or chi-phase microstructure.

The novel alloys according to the invention have broad ranges, which comprise, in weight, percent:

Chromium: 25 to 27

Nickel: 20 to 40

Molybdenum: 5 to 7.0
Nitrogen: 0.25 to 0.30
Iron: Balance.

Chromium contributes to the oxidation and general corrosion resistance of the alloy. It also is present for its effects of contributing to the desired high CCCT values and promoting the solubility of nitrogen, which is a salient factor in keeping the alloy austenitic. At the same time, it is found that chromium levels any higher than the level of 27 weight percent tend to cause hot-working problems.

Nickel is present for its purposes of making the alloy austenitic and contributing to the stress corrosion resistance. Preferably, nickel content ranges from 22 to 35 percent, and more preferably from 24 to 27 percent.

The molybdenum content requires rather careful control to keep it within the relatively narrow range of 5 to 7 percent, preferably 5 to 6.5, more preferably 5 to 6 percent. The use of higher amounts of molybdenum is associated with intermetallic phase precipitation and slightly increased hot-working difficulties, and with lesser amounts, the desired high CCCT values are not obtained. Molybdenum contributes to resistance to pitting and crevice corrosion by chloride ions.

Nitrogen is important for its effects of suppressing the development of sigma and chi phases, contributing to the austenitic microstructure of the alloy, and promoting high values of CCCT, but at the same time, the nitrogen content needs to be kept low enough to avoid porosity and hot-working difficulties. As is known, nitrogen increases the strength of the steel and enhances the crevice corrosion resistance.

Though the elements discussed above are the ones that are believed to be essential in respect to obtaining a desirable combination of high CCCT values together with adequate hot workability and other corrosion resistance, there are other elements which may be present in addition to iron, either in small amounts as unavoidable impurities or as elements purposefully added for some auxiliary purpose.

Of such other elements, the alloy may contain up to 2 percent manganese which tends to increase the alloy's solubility of nitrogen. Manganese is typically present but it promotes intermetallic phase precipitation, and preferably the maganese content is less than 0.75 weight percent.

The alloy can also contain residual levels of carbon, phosphorus, silicon, aluminum and copper. Carbon may range up to 0.05 weight percent, and preferably up to 0.03 percent with a practical lower limit of about 0.01 percent. Silicon and aluminum are typically present in raw materials, may be used as deoxidizers, and should be present in incidental amounts. Copper is typically present in raw materials, decreases nitrogen solubility and may increase hot working problems. Copper may be present up to 0.75 weight percent, preferably up to 0.5 percent.

Stabilizing elements, such as Ti, Nb, Zr, Ta, and Hf, are strong nitride formers and should be minimized. Titanium tends to reduce austenite stability and promotes second phase precipitation, and should be maintained below about 0.2 percent. Niobium may deplete the alloy of desirable elements and preferably is kept below 0.5 weight percent.

The alloy will invariably contain some sulfur as an unavoidable impurity of up to 0.01 weight percent as a result of typical argon-oxygen-decarburization practices (AOD). Sulfur is an undesirable impurity which tends to reduce castability, hot workability, and weldability. Preferably the sulfur content ranges up to 0.006 percent, or lower. As is known, cerium and/or calcium may be added to tie up sulfur to minimize hot working problems related to sulfur.

In order to more completely understand the present invention, the following examples are presented.

EXAMPLE I

A series of laboratory heats of the following compositions were melted and processed to 0.062 inch (1.6 mm).

TABLE I

| | Composition of the Experimental Alloys | | | | | |
|---|---|---|---|---|---|---|
| Alloy # | 47 | 48 | 49 | 50 | 51 | 52 |
| Cr | 24.77 | 25.00 | 25.05 | 27.43 | 27.42 | 27.20 |
| Ni | 24.63 | 24.92 | 25.00 | 25.04 | 25.00 | 24.52 |
| Mo | 6.32 | 6.39 | 6.38 | 6.41 | 6.42 | 5.56 |
| Mn | 0.51 | 0.52 | 0.55 | 0.52 | 0.64 | 0.53 |
| C | 0.013 | 0.030 | 0.018 | 0.012 | 0.017 | 0.007 |
| N | 0.20 | 0.18 | 0.26 | 0.25 | 0.29 | 0.26 |
| P | 0.025 | 0.024 | 0.021 | 0.024 | 0.029 | 0.030 |
| S | 0.002 | 0.002 | 0.002 | 0.002 | 0.003 | 0.005 |
| Ce | 0.032 | 0.030 | 0.019 | 0.0074 | NA | NA |
| Ca | 0.0011 | 0.0020 | 0.0017 | 0.0007 | NA | NA |
| Si | 0.38 | 0.41 | 0.38 | 0.42 | 0.39 | 0.38 |
| Cu | 0.18 | 0.19 | 0.19 | 0.19 | 0.19 | 0.20 |
| Al | 0.010 | 0.009 | 0.009 | 0.011 | 0.006 | 0.006 |
| Ti | 0.014 | 0.015 | 0.015 | 0.015 | NA | NA |
| Fe | Balance | Balance | Balance | Balance | Balance | Balance |

NA - Not Analyzed, but should be similar to previous heats.

Each of the compositions was prepared by vacuum induction melting suitable fifty-pound (22.7 Kg) heats and then cast into ingots. Because of the limitations of the laboratory equipment, Ce and Ca were added to control sulfur effects. The ingots were heated to a hot-forging temperature (2300 degrees Fahrenheit or 2200 degrees Fahrenheit) and pressed into a square cross-section, being then approximately 12 inches long and 3 inches square in cross section, and then pressed to form sheet bars which are approximately of the same length but 1.5 inches thick and spread to 6 inches wide.

The next step was a hot rolling of the sheet bar to a thickness of 0.5 inch at a hot-rolling temperature of approximately 2300 degrees Fahrenheit, following which the material was hot-sheared. Butt portions of the hot-rolled material were then reheated to 2300 degrees Fahrenheit and hot-rolled to form a hot band having a thickness of 0.150 inch (3.8 millimeters).

Samples of the hot-band material were annealed (15 minutes time-at-temperature and then air-cooled, using an annealing temperature of 2150 degrees Fahrenheit or 2250 degrees Fahrenheit). The annealed samples were then given a metallographic examination to detect ferrite or sigma phase.

After the hot-rolled band was given a suitable annealing treatment and then, after descaling and pickling, the material was cold-rolled to a thickness of 0.062 inch (1.6 millimeters). The cold-rolled material was further processed by being annealed (5 minutes time-at-temperature and air-cooled), then descaled, pickled, skin-passed for flatness, and degreased. Some of the material so treated was autogenous welded (tungsten-inert-gas full-penetration welds) before taking therefrom metallographic samples, tensile-test samples, and corrosion-test samples.

Some of the heats developed cracking during the pressing of the ingot into a square cross section and could not be processed further; some of the other ingots developed such cracking while being flattened to form the above-mentioned sheet bar. Still other candidate alloy compositions survived the above-mentioned hot forging and pressing without undue cracking and were processed further.

Of the alloys whose compositions are given above, the alloys 51 and 52 cracked excessively during initial hot working, and were not processed further. The alloy 50 cracked during spreading and hot rolling, but was able to be processed to the point of obtaining samples for testing.

Samples of hot rolled band annealed at different temperatures exhibit different ferrite and sigma phases. Hot-band samples of the alloys 47 and 49 were free of ferrite and sigma phase after being annealed 15 minutes at 2150 degrees Fahrenheit and then air-cooled. The alloy 48, so treated, had some sigma phase, but it was free of ferrite and sigma phase after being similarly annealed at 2250 degrees Fahrenheit. The alloy 50 showed traces of ferrite and sigma, even after being similarly annealed at 2250 degrees Fahrenheit. Accordingly, in this work the alloys 47 and 49 were annealed at 2150 degrees Fahrenheit and the alloys 48 and 50 were annealed at 2250 degrees Fahrenheit before being further processed by descaling, pickling, and cold rolling to the thickness of 0.062 inch, at which they were tested.

In the annealing step following the above-mentioned cold rolling, the same temperatures as before were used with each alloy, but for a time at temperature of 5 minutes instead of 15 minutes. After being annealed under such conditions and air cooled, the materials were descaled, pickled, skin-passed for flatness, and degreased. A portion of the material was autogenously welded (tungsten inert-gas, full-penetration welds). Metallographic samples, tensile-test specimens, and corrosion-test samples were cut from the welded and the unwelded portion of each heat.

The room-temperature tensile-test properties (average of 2 tests per condition, except as noted) are shown in the following Table 2:

TABLE 2

Results of Room Temperature Tensile Tests 0.062 inch Thick Material

| Heat/ Condition | Yield Strength | Tensile Strength | Elongation (in 2") | Elongation (in .5" over weld) |
|---|---|---|---|---|
| 47/plain | 70,700 | 114,500 | 38.0% | 30/40%* |
| 47/welded | 61,500 | 109,100 | 39.5% | |
| 48/plain | 62,800 | 109,500 | 42.8% | 30.0%* |
| 48/welded | 66,200 | 110,900 | 19.0% | |
| 49/plain | 62,000 | 111,200 | 47.0% | 32/37%* |
| 49/welded | 63,400 | 110,000 | 39.0% | |
| 50/plain | 63,200 | 114,300 | 46.0% | 26.0% |
| 50/welded | 62,800 | 113,800 | 43.0% | |

*range of 2 tests
**single test

The results in crevice-corrosion test conducted according to ASTM Standard G-48 are summarized below in Table 3.

TABLE 3

| Heat/Condition | Maximum Temp. for No Attack | Minimum Temp. for Serious Attack |
|---|---|---|
| 47/plain | 40 C. | 43 C. |
| 48/plain | <40 C. | 46 C. |
| 49/plain | 43 C. | 52 C. |
| 50/plain | 43 C. | 46 C. |
| 47/welded | 43 C. | 46 C. |
| 48/welded | <40 C. | 46 C. |
| 49/welded | 43 C. | 52 C. |
| 50/welded | 43 C. | 54 C. |

EXAMPLE II

In further experimental work, there were melted seven additional heats having other alloy compositions as indicated below in Table 4:

TABLE 4

Composition of the Experimental Alloys

| ALLOY # | 86 | 87 | 88 | 89 | 90 | 91 | 92 |
|---|---|---|---|---|---|---|---|
| Cr | 22.57 | 22.52 | 23.02 | 25.07 | 25.17 | 27.20 | 27.14 |
| Ni | 24.59 | 24.66 | 24.66 | 24.57 | 24.64 | 24.52 | 24.61 |
| Mo | 6.29 | 6.29 | 6.31 | 5.51 | 5.53 | 5.56 | 5.06 |
| Mn | 0.51 | 0.52 | 0.52 | 0.52 | 0.52 | 0.53 | 0.52 |
| C | 0.007 | 0.012 | 0.008 | 0.007 | 0.009 | 0.007 | 0.008 |
| N | 0.18 | 0.26 | 0.30 | 0.26 | 0.30 | 0.26 | 0.30 |
| P | 0.026 | 0.024 | 0.026 | 0.027 | 0.026 | 0.030 | 0.030 |
| S | 0.003 | 0.002 | 0.004 | 0.003 | 0.004 | 0.005 | 0.004 |
| Ce | 0.013 | 0.018 | 0.012 | 0.017 | 0.013 | 0.012 | 0.011 |
| Ca | 0.0017 | 0.0013 | 0.0015 | 0.0017 | 0.0014 | 0.0015 | 0.0019 |
| Si | 0.38 | 0.40 | 0.39 | 0.39 | 0.40 | 0.41 | 0.43 |
| Cu | 0.19 | 0.19 | 0.19 | 0.19 | 0.19 | 0.19 | 0.19 |
| Al | 0.003 | 0.003 | 0.003 | 0.003 | 0.003 | 0.003 | 0.003 |
| Fe | Bal | Bal. | Bal. | Bal. | Bal. | Bal. | Bal. |

The experimental alloys given in Table 4 were designed to provide greater austenite stability as compared with the alloys of experimental heats given in Table 1. The alloys in Table 1 displayed a poorer than expected corrosion resistance which was attributed initially to phase stability problems, namely, sigma precipitation. By design, experimental alloys given in Table 4 had a high chromium content in conjunction with nitrogen, while the nickel content was maintained relatively low to minimize the cost of the alloy, and accordingly the alloy phase stability was controlled principally by the ntirogen and molybdenum components of the alloy. The nitrogen content while stabilizing the austenite, was maintained at a fairly low maximum level to avoid problems with the resultant reduced hot workability. Thus, it was believed necessary to reduce the molydbenum content of the higher chromium content alloys. It was observed from the corrosion data of the experimental alloys given in Table 4 that the poor corrosion performance of the alloys occurred because of poor surface quality of test samples. Alloys with a higher molybdenum content can provide good corrosion properties when proper attention is directed to the surface preparation of test specimens. A ground surface was selected as a standard surface preparation to give the most accurate and reproducible results from samples of the alloys given in the Table 4 as indicative of the inherent corrosion resistant properties of the alloys comprising this class of heats. The sensitivity to the condition of the test piece surface is due in large measure to a very low pickling rate exhibited by these alloys which may result in remnants of chrome depleted subscale surfaces undergoing testing unless care is taken to avoid this condition. Surface grinding of the specimens completely eliminates this condition. The crevice corrosion resistances of the alloys, using test specimens provided with machine ground surface, are given in Table 5 as follows:

TABLE 5

| Heat | Maximum Temp. for No Attack | Minimum Temp. for Serious Attack |
|---|---|---|
| 87 | 40 degrees C. | 55 degrees C. |
| 89 | 52 degrees C. | 55 degrees C. |
| 90 | 52 degrees C. | 55 degrees C. |
| 91 | 52 degrees C. | 55 degrees C. |
| 92 | 58 degrees C. | 60 degrees C. |

These results demonstrate with respect to heats 89–92 a self-consistent and a maximum temperature for no attack value that can be taken as a critical crevice corrosion temperature (CCCT). The data for heat 87 are inconsistent and indicate a CCCT less than 45 degrees C. but, more probably indicate a CCCT of between 50 and 55 degrees C. Greater details of the corrosion test as summarized by Table 5 are given in the following Table 6:

TABLE 6

Results of ASTM G-48 Crevice Corrosion Tests
0.052 inch Thick Material
Annealed 2150 degrees F., 5 minutes, Water Quenched
hand ground surfaces

| Heat | Temperature | Wt. Loss, mg./cm. | Edges Attacked | Faces Attacked |
|---|---|---|---|---|
| 87 | 40 C. | 0.014 | 1 | 0 |
| 87 | 40 C. | 0.010 | 0 | 0 |
| 87 | 45 C. | 0.136 | 1 | 0 |
| 87 | 45 C. | 0.082 | 1 | 0 |
| 87 | 50 C. | 0.008 | 0 | 0 |
| 87 | 50 C. | 0.017 | 0 | 0 |
| 87 | 55 C. | 1.094 | 4 | 0 |
| 87 | 55 C. | 0.381 | 4 | 1 |
| 89 | 45 C. | 0.082 | 0 | 0 |
| 89 | 45 C. | 0.079 | 0 | 0 |
| 89 | 50 C. | 0.028 | 0 | 0 |
| 89 | 50 C. | 0.025 | 0 | 0 |
| 89 | 52 C. | 0.010 | 0 | 0 |

TABLE 6-continued

Results of ASTM G-48 Crevice Corrosion Tests
0.052 inch Thick Material
Annealed 2150 degrees F., 5 minutes, Water Quenched
hand ground surfaces

| Heat | Temperature | Wt. Loss, mg./cm. | Edges Attacked | Faces Attacked |
|---|---|---|---|---|
| 89 | 52 C. | 0.014 | 1 | 0 |
| 89 | 55 C. | 0.946 | 3 | 0 |
| 89 | 55 C. | 1.468 | 3 | 0 |
| 90 | 45 C. | 0.079 | 0 | 0 |
| 90 | 45 C. | 0.082 | 0 | 0 |
| 90 | 50 C. | 0.032 | 0 | 0 |
| 90 | 50 C. | 0.032 | 0 | 0 |
| 90 | 52 C. | 0.014 | 0 | 0 |
| 90 | 52 C. | 0.046 | 1 | 0 |
| 90 | 55 C. | 0.270 | 2 | 0 |
| 90 | 55 C. | 1.246 | 4 | 0 |
| 91 | 45 C. | 0.060 | 0 | 0 |
| 91 | 45 C. | 0.078 | 0 | 0 |
| 91 | 50 C. | 0.021 | 0 | 0 |
| 91 | 50 C. | 0.017 | 0 | 0 |
| 91 | 52 C. | 0.007 | 0 | 0 |
| 91 | 52 C. | 0.007 | 0 | 0 |
| 91 | 55 C. | 0.231 | 2 | 0 |
| 91 | 55 C. | 0.046 | 1 | 0 |
| 92 | 45 C. | 0.057 | 0 | 0 |
| 92 | 45 C. | 0.021 | 0 | 0 |
| 92 | 50 C. | 0.032 | 0 | 0 |
| 92 | 50 C. | 0.028 | 0 | 0 |
| 92 | 55 C. | 0.025 | 0 | 0 |
| 92 | 55 C. | 0.039 | 0 | 0 |
| 92 | 58 C. | 0.010 | 0 | 0 |
| 92 | 58 C. | 0.007 | 0 | 0 |
| 92 | 60 C. | 0.046 | 0 | 2 |
| 92 | 60 C. | 0.688 | 1 | 1 |

While I have shown and described herein certain embodiments of my invention, I intend to cover as well any change or modification therein which falls within the spirit and scope of the invention as hereinabove disclosed.

I claim as my invention:

1. An austenitic alloy having improved crevice and stress corrosion resistance, the alloy consisting essentially of, in weight percent:

chromium: 25 to 27
nickel: 20 to 40
molybdenum: 5 to 7.0
nitrogen: 0.25 to 0.30
carbon: up to 0.05
iron: balance.

2. An alloy as defined in claim 1, said alloy having, in weight percent:

nickel: 22 to 35
molybdenum: 5 to 6.5.

3. An alloy as defined in claim 1, said alloy having, in weight percent:

nickel: 24 to 27
molybdenum: 5 to 6.5
sulfur: 0 to 0.01
manganese: 0 to 2.

4. As an article of manufacture, an austenitic alloy in the form of sheet or strip, said alloy being substantially completely austenitic and devoid of ferrite, sigma-phase and chi-phase microstructure and having a CCCT of greater than 49° C., said alloy consisting essentially of, in weight percent:

chromium: 25 to 27
nickel: 20 to 40
molybdenum: 5 to 7.0
nitrogen: 0.25 to 0.30
carbon: up to 0.05 iron: Balance.

5. As an article of manufacture, said alloy being one as defined in claim 4 and having in weight percent:
nickel: 22 to 35
molybdenum: 5 to 6.5
manganese: 0 to 2
sulfur: 0.001 to 0.005.

6. As an article of manufacture, said alloy being one as defined in claim 4 and having, in weight percent:
nickel: 24 to 27
molybdenum: 5 to 6.5
sulfur: 0 to 0.006
carbon: 0 to 0.03
manganese: 0 to 2.

7. An article of manufacture as defined in claim 4, said alloy sheet or strip having a desirable combination of properties as evidenced by a CCCT in excess of 49 degrees Centigrade, stress-corrosion resistance at a level better than that of AISI Type 316L stainless steel.

8. An alloy as defined in claim 1, said alloy having, in weight percent, less than 0.75 manganese.

9. An article of manufacture as defined in claim 4, said alloy having, in weight percent, less than 0.75 manganese.

10. As an article of manufacture, an austenitic alloy in the form of sheet or strip, said alloy being substantially completely austenitic and devoid of ferrite, sigma-phase and chi-phase microstructures and having a CCCT in excess of 49° C., the stress-corrosion resistance at a level better than of AISI Type 316 L stainless steel, said alloy consisting essentially of, in weight percent:
chromium: 25 to 27
molybdenum: 5 to 6.5
nitrogen: 0.25 to 0.30
sulfur: 0 to 0.006
nickel: 24 to 27
manganese: 0 to 2
carbon: 0 to 0.03
and the balance of iron.

11. An austenitic alloy having improved crevice and stress corrosion resistance, said alloy being substantially completely austenitic and devoid of ferrite, sigma-phase and chi-phase microstructures, the alloy consisting essentially of, in weight percent:
chromium: 25 to 27
nickel: 20 to 40
molybdenum: 5 to 7.0
nitrogen: 0.25 to 0.30
carbon: up to 0.05
and the balance of iron.

12. An alloy as defined in claim 11, said alloy having, in weight percent, less than 0.75 manganese.

13. An alloy as defined in claim 11, said carbon being up to 0.03.

14. An alloy as defined in claim 11, said alloy having a CCCT of greater than 49° C.

15. As an article of manufacture, an austenitic alloy in the form of sheet or strip, said alloy being substantially completely austenitic and devoid of ferrite, sigma-phase and chi-phase microstructures, said alloy consisting essentially of, in weight percent:
chromium: 25 to 27
nickel: 20 to 40
molybdenum: 5 to 7.0
nitrogen: 0.25 to 0.30
carbon: up to 0.05
and the balance of iron.

16. An article of manufacture as defined in claim 15, said alloy having, in weight percent, less than 0.75 manganese.

17. An article of manufacture as defined in claim 15, said carbon being up to 0.03.

* * * * *